United States Patent [19]

Zunkel

[11] Patent Number: 4,721,946

[45] Date of Patent: Jan. 26, 1988

[54] DOOR CONTROL DEVICE WITH ALARM SWITCH

[76] Inventor: Richard L. Zunkel, 218 Loon Ct., Foster City, Calif. 94404

[21] Appl. No.: 895,306

[22] Filed: Aug. 11, 1986

[51] Int. Cl.[4] ..... G08B 19/00; G08B 13/08

[52] U.S. Cl. ..... 340/521; 340/545; 340/549; 340/686; 116/89; 200/61.7; 200/61.62; 49/13

[58] Field of Search ..... 340/521, 540, 541, 545, 340/549, 686; 116/12-14, 85-89; 200/61.62, 61.7, 61.72, 61.73, 61.81; 49/26, 15, 13, 14

[56] References Cited

U.S. PATENT DOCUMENTS

| | | | |
|---|---|---|---|
| 3,715,537 | 2/1973 | Peterson | 200/61.81 |
| 3,926,140 | 12/1975 | Bargiel | 116/85 |
| 4,016,381 | 4/1977 | Rodseth | 200/61.7 |
| 4,049,934 | 9/1977 | Newlon | 200/61.7 |

*Primary Examiner*—Donnie L. Crosland

[57] ABSTRACT

An apparatus for monitoring the condition of a door which is biased toward a closed position by a closer arm connected to and biased by a door control device including a switch responsive to the position of the closer arm and signaling means connected to the switch. The switch is operable to activate the signaling means and establish a signal in response to the closer arm being disconnected from the door control device and when the door is moved from its fully closed position.

26 Claims, 3 Drawing Figures

FIG. 1
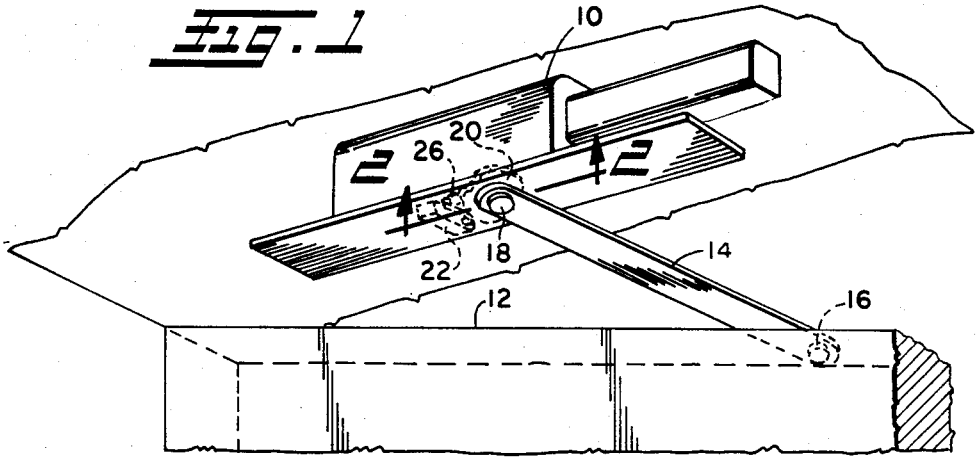
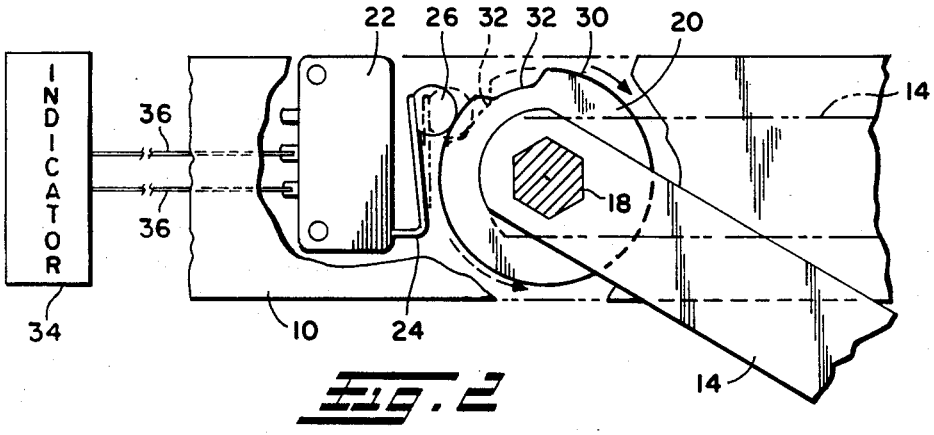
FIG. 2
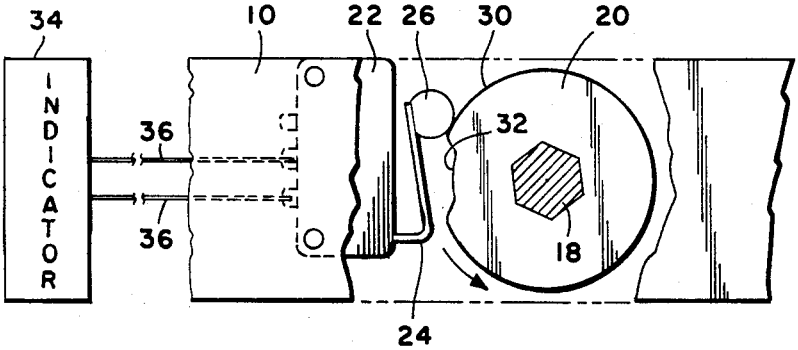
FIG. 3

DOOR CONTROL DEVICE WITH ALARM SWITCH

TECHNICAL FIELD

The present invention relates to a door control device and more particularly to apparatus for monitoring the door control device and establishing a signal if the door is opened or if the closer arm which connects the door control device to the door is removed from the door control device.

BACKGROUND OF THE INVENTION

Door control devices which utilize cam switches therein are well known in the art. Examples of such door controlled devices are the door operators disclosed in the Catlett U.S. Pat. Nos. 4,220,051 and 4,333,270. Catlett utilizes cam controlled switches associated with the operator shaft for controlling various functions of the door operator in response to the position of the door or the operator shaft. The cam switches in the Catlett operators are not utilized for alarm purposes but rather for controlling various aspects of operation of the operator. Other known prior art such as the Cashman U.S. Pat. No. 4,124,847 discloses a door switch which is operable to sense opening of a door and actuate an alarm. Cashman is not utilized with a door control device.

A problem associated with the prior art devices such as Cashman which sense door position is that removal of the door control arm which interconnects the door control device to the door does not actuate an alarm when the door remains closed. This is particularly undesireable in high security applications which utilize door control devices such as door operators and door closers. The closer arm is a relatively rigid metallic member which in the past has been removed from the door control device and utilized as a weapon in high security penal institutions such as jails and prisons. In the prior art if the door control arm is removed from the door operator or the door closer and the door is not opened, no alarm will be sounded.

Accordingly, it is the provision of the present invention to provide a new and improved door control device which is operable to indicate when the closer arm has been removed from the door control device.

SUMMARY OF THE INVENTION

The present invention provides a new and improved system for monitoring the condition of a door which is operable to establish a signal in response to the door being opened if the closer arm is removed from the door control device.

Another provision of the present invention is to provide a system for monitoring the condition of a door which is biased toward a closed position by a closer arm connectable to an operating shaft of a door closer including switch means responsive to the position of the operating shaft for establishing a signal when the position of the operating shaft is changed from its door-closed position, signaling means connected to the switch means for indicating the position of the operating shaft and wherein the switch means is operable to establish a signal in response to the operating shaft of the closer being rotated from its door-closed position.

Another provision of the present invention is to provide a new and improved system for monitoring the condition of a door as set forth in the next preceeding paragraph wherein when the closer arm is disconnected from the operating shaft, the operating shaft of the door closer is rotated from its door-closed position.

Another provision of the present invention is to provide a system for monitoring the condition of a door which is biased toward a closed position by a closer arm connected to and biased by a door closer including switch means responsive to the position of the closer arm for establishing a signal indicative of the position of the closer arm and signaling means connected to the switch means for indicating the position of the closer arm. The switch means is operable to establish the signal indicative of the position of the door closer in response to the closer arm being disconnected from the door closer.

Still another provision of the present invention is to provide a system for monitoring the condition of a door which is biased toward a closed position by a closer arm connected to an operating shaft of a door control device including switch means responsive to the position of the operating shaft of the door control device for establishing a signal when the position of the operating shaft is changed from its door-closed position, signaling means connected to the switch means for indicating the position of the operating shaft and wherein the switch means is operable to establish the signal in response to the operating shaft being rotated from its door-closed position.

A still further provision of the present invention is to provide a new and improved system for monitoring the condition of a door which is biased toward a closed position by a closer arm connected to and biased by a door control device including switch means responsive to the position of the closer arm for establishing a signal indicative of the position of the closer arm and signaling means connected to the switch means for indicating the position of the closer arm. The switch means is operable to establish the signal indicative of the condition of the closer arm in response to the closer arm being disconnected from the door-controlled device.

A still further provision of the present invention is to provide a system for monitoring the condition of a door as is set forth in preceding paragraph wherein the door control device comprises a door closer.

DESCRIPTION OF THE DRAWINGS

FIG. 1 is a schematic view of a door closer/operator for biasing the door toward its closed position which includes the system for monitoring the condition of the door of the present invention.

FIG. 2 is a partial cross-sectional view taken approximately along the lines 2—2 of FIG. 1 more fully disclosing the cam and switch means and closer arm of the present invention in their open position in full lines and their door closed position in phantom lines.

FIG. 3 is a partial cross-sectional view similar to FIG. 2 but illustrating the cam and switch means in their position when the closer arm is removed from the operator shaft.

DESCRIPTION OF THE PREFERRED EMBODIMENT

Referring to FIG. 1, a door control device 10 is illustrated for closing a door 12. As is well known the door control device 10 exerts a biasing force to effect closing of the door 12 through the closer arm 14. The closer arm 14 is pivotably connected to the door 12 at one end 16 thereof and is fixed to an operating shaft 18 of the door control device 10 at the opposite end thereof for rotation therewith.

The door control device 10 may be a door closer such as disclosed in U.S. Pat. No. 4,115,897 or may be a door operator such as disclosed in the Callett U.S. Pat. No. 4,333,270 both of which are incorporated by reference herein. A door closer, as is well known, functions to close a door after the door has been manually opened. The opening of the door rotates the door closer arm and operating shaft to compress a biasing spring in the door closer as is well known. When the door is released, the compressed spring rotates the operating shaft 18 and door closer arm 14 to effect closing of the door in a well known manner.

A door operator, as is well known, operates to power open a door upon command, usually in response to high pressure hydraulic fluid or air being introduced into the operator or in response to actuation of an electric motor. Opening of the door compresses a spring in the door operator in a well known manner. When the door is opened and released, the compressed door operator spring effects rotation of the operator shaft 18 and the door closer arm 14 to effect closing of the door in a well known manner. The term door contol device as used herein shall mean a door operator and/or a door closer. For the purposes of illustration, the invention will be described in conjunction with a door closer 10. The structure of the door closer and/or operator will not be described in detail as it is not part of the present invention. The present invention may be added on to or incorporated in various known closers and/or operators.

As is more fully illustrated in FIG. 2, the door closer 10 includes a cam 20 connected to the operating shaft 18 for rotation therewith. Switch means 22 is mounted on the body of the door closer 10 adjacent to the cam 20. The switch means 22 includes a switch arm 24 which is operable to actuate and deactuate switch 22 dependent upon position of cam 20. A cam follower 26 is disposed on the end of the switch arm 24 and engages with an outer cam surface 30 on the cam member 20. The cam surface 30 is generally cylindrical and includes a notch 32 disposed therein. The notch 32 allows the cam follower 26 to move away from the switch 22, to thereby deactuate switch 22. Thus, in the preferred embodiment, the switch 22 will only be deactuated when the cam follower engages in the notch 32 in the cam surface 30 and will be actuated at all other times. It should be appreciated however, that other configurations of cam switches and cams could be utilized without departing from the scope of the present invention. In addition, other switching means such as hall effect devices, reed switches, etc. could be utilized in the present invention instead of the cam switch 22 and the cam 20 to sense the position of the operator shaft 18.

FIG. 2 illustrates the position of the cam 20 and the cam follower 26 when the door 12 is in its fully closed position. When the door 12 is opened, the closer arm 14 will rotate the operating shaft 18 of the closer 10 to compress the internal biasing spring of the door closer 10 as has been described herein above. Rotation of operator shaft 18 and cam 20 will disengage the cam follower 26 from the notch 32 in the cam surface 30 to thereby actuate switch 22. Thus, switch 22 functions to establish a signal when the door 12 is rotated from its door closed position. The switch 22 is connected by wires 36 to an indicator 34 and switch 22 will be operable to establish a signal to indicator 34 which is indicative of the fact that the door 12 has been rotated from its fully closed position. If the closer device is utilized in a high security situation, the indicator 34 may be an alarm or other such indicator.

When the door closer 10 is connected to the door 12 by the arm 14, the door closer 10 is preloaded. Preloading is a common term of the art which indicates that the spring or biasing means in the closer 10 is slightly compressed to exert a biasing force on the door 12 when the door 12 is in its fully closed position. If a preload force were not exerted by the closer 10 on the door 12, the door 12 would be susceptible to opening as a result of the application of minimal forces to the door 12. It is undesireable for a minimal force such as wind or a slight vacuum to be able to move the door 12 from its fully closed position. Additionally, as is known, preloading facilitates latching of the door when it is closed and the resistance of a mechanical latch must be overcome. Accordingly, it is well known in the art to slightly rotate the door closer arm 14 and operating shaft 18 to bias or preload the spring in the closer 10 when the door is in its fully closed position. This is accomplished upon installation when the installer insures that the shaft 18 will be slightly biased by the internal spring of the closer 10 when the door is in its fully closed position.

It should be apparent that when the door 12 is in its fully closed position, the arm 14 will have a position as is illustrated schematically in FIG. 2. In this position, the operator shaft 18 will exert a biasing force on the arm 14 and on the door 12 to bias the door 12 toward its closed position. If the arm 14 is disconnected from the operating shaft 18, the preload force which is normally exerted on the door 12 will effect rotation of the operating shaft 18 and the cam 20 therewith. As is illustrated in FIG. 3, a slight rotation of the shaft 18 will disengage cam follower 26 from the notch 32 in the cam surface 30 and hence actuate switch 22. Thus, the present invention not only monitors the position of the door 12 but also the position of the operating shaft 18 and closer arm 14. Removal of the closer arm 14 will effect actuation of switch 22 and of the indicator 34 even if the door 12 is not opened. This is a distinct advantage over the known prior art which only monitors the position of the door 12 and which is not operable to indicate that the door closer arm 14 has been disconnected from the operating shaft 18.

From the foregoing, it should be apparent that a new and improved system for monitoring the condition of a door 12 which is biased toward a closed position by a closer arm 14 connectable to an operating shaft 18 of a door control device 10 has been provided. The system includes switch means 22 responsive to the position of the operating shaft 18 and/or the closer arm 14 of the door control device 10 for establishing a signal when the position of the operating shaft 18 and/or closer arm 14 is changed from its door closed position. Signaling means such as the indicator 34 are connected to the switch means 22 for indicating the position of the operating shaft 18 of the door control device 10. The switch means 22 is operable to establish a signal in response to the operating shaft 18 of the door control device 10 being rotated from its door closed position. The switch means is operable when the closer arm 14 is disconnected from the operating shaft 18 of the door control device 10 to initiate an alarm condition.

While the present invention has been illustrated in conjunction with a door closer 10, it should be appreciated that it is equally adaptable to a door operator.

Additionally, while a cam switch 22, has been utilized to indicate the position of the operating shaft 18 and hence the position of the door 10 and closer arm 14, it is within the scope of the present invention to sense the position of the closer arm 14 and hence the door 12 by directly sensing the closer arm 14 and its removal from the operating shaft 18. For example, a sensible device such as a magnet could be located on the closer arm 14 and a sensing device such as a reed switch could be located on the door control device 10. The reed switch would be activated when the arm 14 and hence the door 12 was moved from its door closed position. If the arm 14 was removed from the door control device 10, the arm 14 would be moved from its door closed position and the reed switch and alarm would be acutated. Many other types of sensors such as hall effect or photoelectric switches could be utilized to sense movement of the closer arm 14 from its door closed position ie the door is opened or the closer arm 14 is removed from the door control device.

What I claim is:

1. Apparatus for monitoring the condition of a door which is biased toward a closed position by a closer-arm connectable to an operating shaft of a door closer comprising switch means responsive to the position of the operating shaft of the door closer for establishing a signal when the position of the operating shaft is changed from its door closed position, and signaling means connected to said switch means for indicating the position of the operating shaft of the door closer, said operating shaft of the door closer being rotated from the door-closed position when the closer arm is disconnected from the operating shaft and wherein said switch means is actuated when the closer arm is disconnected from the operating shaft of the door closer.

2. Apparatus for monitoring the condition of a door as defined in claim 1 further including a cam operatively associated with the operating shaft of the door closer, a cam follower connected to said switch means and responsive to the position of said cam, said cam effecting actuation of said switch means and the establishment of said signal when the operating shaft of the door closer is rotated from its door closed position, said cam effecting actuation of said switch means when the closer arm is disconnected from the operating shaft of the door closer.

3. Apparatus for monitoring the condition of a door as defined in claim 1 wherein said cam is connected to the operating shaft of the door closer for rotation therewith and said switch means is securable on the door closer.

4. Apparatus for monitoring the condition of a door as defined in claim 1 wherein said signaling means comprises an alarm which is actuable by said switch means when the door is moved from a fully-closed position and when the closer arm is disconnected from the operator shaft of the door closer.

5. Apparatus for monitoring the condition of a door which is biased toward a closed position by a closer arm connected to and biased by a door closer comprising a switch means responsive to the position of the closer arm for establishing a signal indicative of the position of the closer arm, and signaling means connected to said switch means for indicating the position of the closer arm, said switch means being operable to establish said signal indicative of the condition of the closer arm in responsive to the closer arm being disconnected from the door closer.

6. Apparatus for monitoring the condition of a door as defined in claim 5 further including a cam operatively associated with the door closer, a cam follower connected to said switch means and responsive to the position of said cam, said cam effecting actuation of said switch and the establishment of said signal when the closer arm is disconnected from the door closer.

7. Apparatus for monitoring the condition of a door as defined in claim 6 wherein said cam is connectable to the operating shaft of the door closer and said switch means is securable on the door closer.

8. Apparatus for monitoring the condition of a door as defined in claim 6 wherein said signaling means comprises an alarm which is actuatable by said switch means when the door is moved from its fully-closed position and when the closer arm is disconnected from the door closer.

9. Apparatus for monitoring the condition of a door which is biased toward a closed position by a closer-arm connectable to an operating shaft of a door control device comprising switch means responsive to the position of the operating shaft of the door control device for establishing a signal when the position of the operating shaft is changed from its door closed position, signaling means connected to said switch means for indicating the position of the operating shaft of the door control device, said switch means being operable to establish said signal in response to the operating shaft of the door control device being rotated from its door closed position, and wherein the operating shaft of the door control device is rotated from its door-closed position when the closer arm is disconnected from the operating shaft and said switch means is actuated when the closer arm is disconnected from the operating shaft of the door control device.

10. Apparatus for monitoring the condition of a door as defined in claim 9 wherein said door control device comprises a door closer.

11. Apparatus for monitoring the condition of a door as defined in claim 9 wherein said door control device comprises a door operator.

12. Apparatus for monitoring the condition of a door as defined in claim 10 further including a cam operatively associated with the operating shaft of the door closer, a cam follower connected to said switch means and responsive to the position of said cam, said cam effecting actuation of said switch means and the establishment of said signal when the operating shaft is rotated from its door closed position.

13. Apparatus for monitoring the condition of a door as defined in claim 11 further including a cam operatively associated with the operating shaft of the door operator, a cam follower connected to said switch means and responsive to the position of said cam, said cam effecting actuation of said switch means and the establishment of said signal when the operating shaft is rotated from its door closed position.

14. Apparatus for monitoring the condition of a door as defined in claim 12 wherein said cam is connected to the operating shaft for rotation therewith and said switch means is securable on the door closer.

15. Apparatus for monitoring the condition of a door as defined in claim 13 wherein said cam is connected to the operating shaft for rotation therewith and said switch means is securable on the door operator.

16. Apparatus for monitoring the condition of a door as defined in claim 10 wherein said signaling means comprises an alarm which is actuable by said switch means when the door is moved from a fully-closed position and when the closer arm is disconnected from the operator shaft.

17. Apparatus for monitoring the condition of a door as defined in claim 11 wherein said signaling means comprises an alarm which is actuable by said switch means when the door is moved from a fully-closed position and when the closer arm is disconnected from the operator shaft.

18. Apparatus for monitoring the condition of a door which is biased toward a closed position by a closer arm connected to and biased by a door control device comprising switch means responsive to the position of the closer arm for establishing a signal indicative of the position of the closer arm, and signaling means connected to said switch means for indicating the position of the closer arm, said switch means being operable to establish said signal indicative of the condition of the closer arm in responsive to the closer arm being disconnected from the door control device.

19. Apparatus for monitoring the condition of a door as defined in claim 18 wherein said door control device comprises a door closer.

20. Apparatus for monitoring the condition of a door as defined in claim 18 when said door control device comprises a door operator.

21. Apparatus for monitoring the condition of a door as defined in claim 19 further including a cam responsive to the position of the closer arm, a cam follower connected to said switch means and responsive to the position of said cam, and wherein the closer arm is disconnected from the door closer said cam effects actuation of said switch means.

22. Apparatus for monitoring the condition of a door as defined in claim 20 further including a cam responsive to the position of the closer arm, a cam follower connected to said switch means and responsive to the position of said cam, and wherein when the closer arm is disconnected from the door operator said cam effects actuation of said switch means.

23. Apparatus for monitoring the condition of a door as defined in claim 21 wherein said signaling means comprises an alarm which is actuatable by said switch means when the door is moved from its fully-closed position and when the closer arm is disconnected from the door closer.

24. Apparatus for monitoring the condition of a door as defined in claim 22 wherein said cam is connectable to the operating shaft of the door operator and said switch means is securable on the door operator.

25. Apparatus for monitoring the condition of a door as defined in claim 22 wherein said signaling means comprises an alarm which is actuatable by said switch means when the door is moved from its fully-closed position and when the closer arm is disconnected from the door operator.

26. Apparatus for monitoring the condition of a door as defined in claim 24 wherein said signaling means comprises an alarm which is actuatable by said switch means when the door is moved from its fully-closed position and when the closer arm is disconnected from the door operator.

* * * * *